United States Patent [19]

Ryd

[11] 4,132,361

[45] Jan. 2, 1979

[54] FLUID MIXING DEVICE

[75] Inventor: Per-Olof Ryd, Skara, Sweden

[73] Assignee: Atlas Copco Aktiebolag, Nacka, Sweden

[21] Appl. No.: 799,988

[22] Filed: May 24, 1977

[30] Foreign Application Priority Data

May 24, 1976 [SE] Sweden ..... 7605846

[51] Int. Cl.[2] ..... B05B 7/04

[52] U.S. Cl. ..... 239/417.5; 239/526; 137/604

[58] Field of Search ..... 239/407, 410, 412, 417, 239/417.5, 526; 137/604, 859

[56] References Cited

U.S. PATENT DOCUMENTS

| | | | |
|---|---|---|---|
| 1,960,736 | 5/1934 | Franks | 239/412 |
| 2,633,150 | 3/1953 | Lewis | 137/604 |
| 3,977,608 | 8/1976 | Bullock | 239/410 |

*Primary Examiner*—Johnny D. Cherry

*Attorney, Agent, or Firm*—Flynn & Frishauf

[57] ABSTRACT

A fluid mixing device for, for example, mixing of the pigment carrier and the hardener of a two-component paint, comprising a mixing chamber and a resilient membrane dividing the mixing chamber into two compartments. The compartments have separate inlets and a common outlet, the common outlet being arranged so as to continuously communicate with one of the compartments but to be open toward the separate inlets only when the membrane is pressed off a seat surrounding the outlet. The membrane, which is formed with a central opening for maintaining the continuous communication between the outlet and one of the compartments, is preloaded toward its seat so as to break the communication between the outlet and the other of the compartments as the ratio between the fluid pressures in the compartments is below a certain level. The mixing device may be incorporated in the handle of a spray gun, wherein a mixing tube is connected at its outlet to accomplish a final mixing.

10 Claims, 4 Drawing Figures

FLUID MIXING DEVICE

SPECIFICATION

BACKGROUND OF THE INVENTION

This invention relates to a fluid mixing device for mixing two fluids. In particular the invention concerns a mixing device including a check valve for one of the fluids to be mixed.

A prior art device of this kind comprises a movably guided valve body, and a problem concerned therewith is that the movably guided valve body tends to get jammed and thereby impairs the operation of the mixing device. A fluid mixing device of this type is described in German patent publication No. 2312935.

The present invention intends to make a fluid mixing device by which the above mentioned problem is avoided.

DETAILED DESCRIPTION

Figure 1:
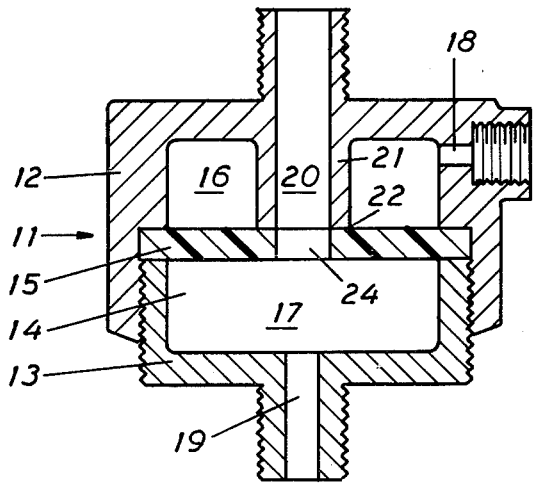
FIG. 1 shows a longitudinal section through a mixing device according to the invention.
Figure 2:
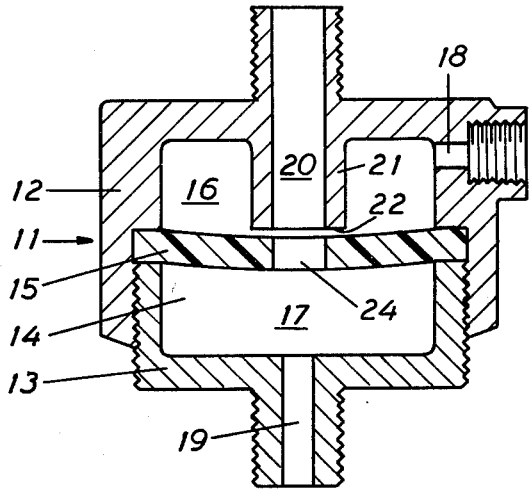
FIG. 2 shows the same section as FIG. 1 but showing the valve mechanism in open position.

The mixing device shown in FIGS. 1 and 2 comprises a housing 11 which comprises two halves 12, 13 joined by a thread. The housing 11 encloses a mixing chamber 14 which is divided into two compartments 16, 17 by a resilient membrane. The membrane 15 which has the form of a rubber washer is clamped at its periphery between opposite shoulders on the halves 12, 13 of the housing 11.

The mixing chamber 14 is provided with an inlet 18 for one of the fluids to be mixed and an inlet 19 for the other fluid. These inlets 18, 19 are situated at opposite sides of the resilient membrane 15; that is in each of the compartments 16, 17 of the mixing chamber 14.

Moreover, the mixing chamber 14 is provided with an outlet 20 which comprises a tube shaped flange 21 which extends through the compartment 16 of the chamber 14 toward the membrane 15. The tubular flange 21 is formed with an annular end surface 22 which is arranged to sealingly cooperate with the membrane 15 as the latter is in its rest position (see FIG. 1).

The membrane 15 is also provided with a central opening 24 through which the compartment 17 of the chamber 14 continuously communicates with the outlet 20.

As the inlets 18 and 19 via supply conduits are connected to pressure sources for the fluids to be mixed, the compartments 16, 17 of the chamber 14 are pressurized by the respective fluid. The fluid supplied to compartment 17 will flow directly out through the outlet 20 via the opening 24 of the membrane 15. The fluid supplied to the compartment 16 requires a certain pressure to suppress the membrane 15 from its sealing contact with the annular surface 22 of the tubular flange 21.

As the pressure in compartment 16 exceeds the pressure in compartment 17 to a certain extent, the membrane 15 is suppressed to the position shown in FIG. 2.

As a result there is formed an annular gap between the membrane and the annular surface. Through this gap the fluid in the compartment 16 is radially introduced into the passage constituted by the central opening 24 of the membrane 15 and the outlet 20.

The main object of the membrane 15 is to form the annular outlet gap from the compartment 16, thereby accomplishing an even dispensing of the fluid from compartment 16 into the fluid supplied via compartment 17. In order to improve the mixing of the fluids, the membrane 15 has such a form and elasticity that the obtained annular gap forms a velocity increasing outlet restriction from compartment 16.

Another purpose of the membrane 15 is to form a check valve for the emitted fluid. As soon as the pressure ratio between compartments 16 and 17 falls below a certain value the membrane 15 is pressed into sealing contact with the annular surface 22 by the pressure in the compartment 17 and by its own pretension. This sealing contact prevents fluid from compartment 17 to reach compartment 16.

The valve function of the membrane 15 is of decisive importance in case the mixing device is used for mixing, for instance, a two-component paint consisting of a pigment carrier and a hardener. The pigment carrier is supplied through the compartment 17 and the hardener through the compartment 16. It is of greatest importance that the pigment carrier or the solvent used for cleaning the device when changing colour cannot penetrate into compartment 16.

As the membrane 15 ensures an effective closure of the compartment 16, it is possible to flush a cleaning solvent through the compartment 17, the outlet 20 and a conduit connected thereto without having to empty or clean the compartment 16. At continued operation, the compartment 16 is automatically connected to the outlet in that the pressure therein is increased above a certain level. Thereby, the membrane 15 is suppressed and defines together with the end surface 22 of the tubular flange 21 the annular outlet gap.

Figure 3:
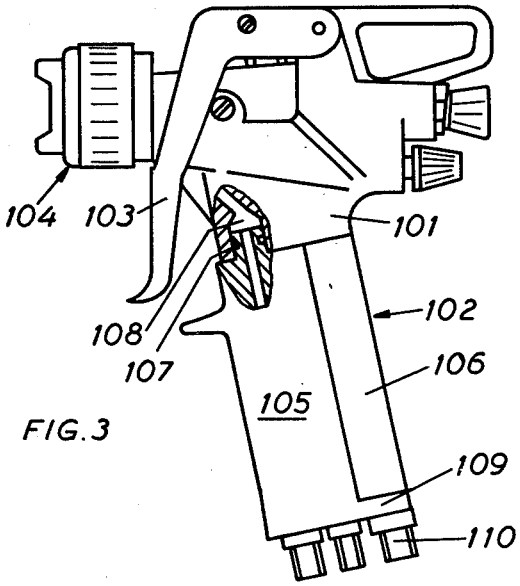
FIG. 3 shows a partly broken side elevation of a spray gun provided with a mixing device according to the invention.
Figure 4:
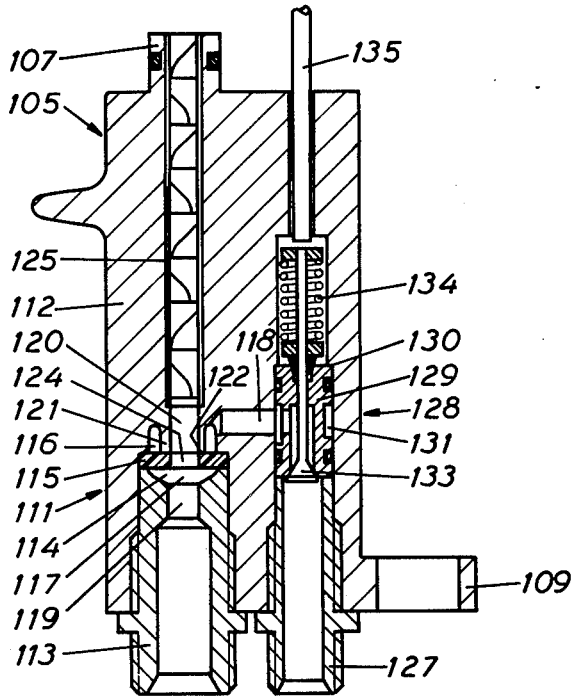
FIG. 4 shows, in larger scale, a longitudinal section through the mixing device incorporated in the spray gun in FIG. 3.

In FIGS. 3 and 4 there is shown a mixing unit specially designed for a spray gun. The mixing unit incorporates a mixing device according to the invention. The shown spray gun is a common low pressure gun in which the spray material is atomized by means of pressure air. The spray gun is described below in connection with spraying of a two-component paint.

The spray gun mainly comprises a gun body 101, a handle 102, a trigger 103 pivotably supported on the gun body 101, a nozzle unit 104 and a spray material valve of the needle type. (Not shown). The nozzle unit includes outlet openings (not shown) for spray material as well as for air.

The handle 102 comprises two parts, a forward mixing unit 105 and a rear air supply unit 106. The mixing unit 105 is attached to the gun in that its upper part is formed with a male portion 107 for engagement with a corresponding female portion 108 on the gun body 101, and that its lower end is provided with an ear 109 by which it is secured relative to the air supply unit 106 by means of a nipple 110.

As being apparent from FIG. 4, the mixing unit 105 comprises a housing 112 in which is enclosed a mixing device 111 according to the invention. The mixing device 111 comprises a mixing chamber 114 which at its lower end is defined by a fluid supply nipple 113 which is inserted into the housing. Between the upper end of the nipple 113 and a shoulder in the housing 112, there is clamped an annular rubber membrane 115 which divides the mixing chamber 114 into an upper compartment 116 and a lower compartment 117.

The lower compartment 117 is provided with an inlet opening 119 which is formed by a longitudinal bore through the nipple 113, and the upper compartment 116 has a lateral inlet opening 118.

As in the above described embodiment, the outlet 120 of the mixing device comprises a tubular flange 121 having an annular end surface 122 which is arranged to sealingly cooperate with the rubber membrane 115 as the latter is in its rest position or as it is biased by the pressure in the compartment 117. A central opening 124 in the membrane 115 interconnects the compartment 117 and the outlet 120.

The outlet 120 is connected to a bore in the housing 112 in which bore there is mounted a mixing tube 125 of any known type. The mixing tube 125 which comprises a number of flow dividing elements is intended to accomplish a secondary or final mixing of the components to be mixed. Such a mixing tube is described in U.S. Patent No. 3,286,992.

Moreover, the mixing unit 105 comprises a connection nipple 127 and an inlet valve 128 for the hardener. The valve 128 comprises a valve housing 129 which is retained against a shoulder 130 by the nipple 127. The nipple is mounted in a bore 131 in the housing 105. A valve body 133 is arranged to sealingly cooperate with the lower end of the valve housing 129. The valve body 133 is biased toward its closed position by a spring 134 and is arranged to be displaced to open position by a maneuver rod 135. The maneuver rod 135 extends through the gun body 101 and is coupled to the trigger 103.

The air supply unit 106 of the gun handle 102 includes a supply valve (not shown) for pressure air, which valve is operated by the trigger 103.

When using the above described spray gun for spraying a two-component paint, the nipple 110 is connected to a pressure air source and the nipples 113 and 127 are connected to pressure sources for the respective component. Painting is commenced in that the trigger 103 is pressed and the spray material valve (for the mixed spray material) as well as the pressure air valve are opened. Pressure air and the pigment carrier of the paint starts to flow through the gun. When operating the trigger 103, the valve body 133 of the supply valve 128 is opened as well, thereby letting the hardener enter the upper compartment 116 of the mixing chamber 114 which thereby is pressurized. As full pressure is reached in compartment 116 the membrane 115 is suppressed and the hardener is dispensed into the pigment carrier as the latter flows toward the outlet 120 and the mixing tube 125.

Downstream of the mixing device 111 the mixing tube 125 is effective to accomplish a secondary mixing of the paint components before the paint reaches the atomizing nozzle 104 of the gun.

An important advantage obtained by the mixing device according to the invention is that the two components are effectively mixed the very first moment they get into contact with each other. This means that the following, secondary mixing is faster which in turn brings down the required minimum length of the mixing tube 125. This means that the mixing unit 105 may be made very compact.

When changing colour of the paint being sprayed, the pigment carrier has to be changed whereas the same hardener can be used. Such a colour change is carried out in such a way that the nipple 113 is connected to a pressure source for a solvent, whereupon the gun is activated until the compartment 117 of the mixing chamber 114, the mixing tube 125 and the rest of the passage downstream thereof are cleaned. However, in order not to waste the hardener the maneuver rod 135 is disconnected from the trigger 103 so that the valve 128 is never opened during the cleaning process. The rubber membrane 115 ensures that the cleaning solvent does not enter into the upper compartment 116 of the mixing chamber 114 and that it does not get into contact with the hardener. After cleaning, the nipple 113 is connected to a conduit supplying a paint of a new colour and the maneuver rod 135 is reconnected to the trigger 103. The gun is again ready for spraying.

This invention is not limited to the described embodiments. For instance, the mixing device according to the invention may very well be used for mixing of non-liquid fluids such as powder. The invention can also be applied to mixing devices for fluids for purposes other than spraying.

What we claim is:

1. In a fluid mixing device for mixing fluids, comprising a chamber (14; 114) having separate inlets (18, 19; 118, 119) and a common outlet (20; 120) for the fluids to be mixed, the improvement comprising:

a resilient membrane (15, 115) arranged so as to divide the chamber (14; 114) into two compartments (16, 17; 116, 117), the inlet (18; 118) for one of the fluids to be mixed being located in one of said two compartments (16; 116), and the inlet (19; 119) for another of the fluids to be mixed being located in the other of said two compartments (17; 117), the outlet (20; 120) comprises a tubular portion (21; 121) which extends through one (16; 116) of said two compartments and which is formed with an annular end surface (22; 122), said annular end surface (22; 122) being disposed substantially parallel to said membrane (15; 115), said membrane (15; 115) being arranged to sealingly cooperate with said annular end surface (22; 122) under the action of a preload and to be separated from said surface (22; 122) at a certain pressure ratio between the fluids in said two compartments, thereby forming an annular discharge gap for the fluid in said one (16; 116) of said two compartments, and said membrane (15; 115) being formed with an opening (24; 124) through which the other (17; 117) of said two compartments continuously communicates with the outlet (20; 120).

2. Mixing device according to claim 1, wherein the membrane (15; 115) comprises an annular rubber washer which at its periphery is secured in the chamber (14; 114).

3. Mixing device according to claim 2, wherein the outlet (120) includes means for connection thereof to a mixing tube, and the chamber (114) at its downstream end is connected to the mixing tube via the outlet (120).

4. Mixing device according to claim 1, wherein the mixing device is an integrated part of a spray gun.

5. Mixing device according to claim 1, wherein the outlet (120) includes means for connection thereof to a mixing tube, and the chamber (114) at its downstream end is connected to the mixing tube via the outlet (120).

6. Mixing device according to claim 1, in combination with a spray gun having a handle (102) and conduit connections (113, 127), for supplying the fluids to be mixed, the mixing device forming a part (105) of the handle (102) of the spray gun, the conduit connections (113, 127) for supplying the fluids to be mixed being located at the outer end of the handle (120).

7. Mixing device according to claim 6, comprising two conduit connections for receiving two respective fluids to be mixed.

8. Mixing device according to claim 6, comprising a secondary mixing tube coupled to the outlet (120).

9. Mixing device according to claim 1, comprising a secondary mixing tube coupled to the outlet (120).

10. Mixing device according to claim 1, having two of said separate inlets for receiving two respective fluids to be mixed.

* * * * *